US005765085A

United States Patent [19]

Law et al.

[11] Patent Number: 5,765,085

[45] Date of Patent: Jun. 9, 1998

[54] FIXING APPARATUS AND FILM

[75] Inventors: Kock-Yee Law, Penfield; Ihor W. Tarnawskyj, Webster; Joseph Mammino, Penfield; Kathleen M. McGrane; Martin A. Abkowitz, both of Webster; Robert M. Ferguson, Penfield; Frederick E. Knier, Jr., Wolcott, all of N.Y.

[73] Assignee: Xerox Corporation, Stamford, Conn.

[21] Appl. No.: 706,057

[22] Filed: Aug. 30, 1996

[51] Int. Cl.[6] ..... G03G 15/20

[52] U.S. Cl. ..... 399/329; 399/333

[58] Field of Search ..... 399/329, 333; 430/99

[56] References Cited

U.S. PATENT DOCUMENTS

| | | | |
|---|---|---|---|
| 3,967,042 | 6/1976 | Laskin et al. | 219/216 X |
| 4,434,355 | 2/1984 | Inagaki et al. | 219/216 |
| 4,501,482 | 2/1985 | Stryjewski | 399/333 |
| 4,514,486 | 4/1985 | Shirose et al. | 430/124 |
| 4,524,119 | 6/1985 | Luly et al. | 430/108 |
| 4,582,416 | 4/1986 | Karz et al. | 399/329 |
| 4,653,897 | 3/1987 | Fromm | 355/3 FU |
| 5,061,965 | 10/1991 | Ferguson et al. | 355/284 |
| 5,084,738 | 1/1992 | Ishikawa | 355/285 |
| 5,087,946 | 2/1992 | Dalal et al. | 355/285 |
| 5,157,446 | 10/1992 | Kusaka | 355/285 |
| 5,182,606 | 1/1993 | Yamamoto et al. | 355/289 |
| 5,293,537 | 3/1994 | Carrish | 399/329 |
| 5,345,300 | 9/1994 | Uehara et al. | 399/329 |
| 5,410,394 | 4/1995 | Wayman et al. | 355/285 |
| 5,418,105 | 5/1995 | Wayman et al. | 430/126 |
| 5,436,712 | 7/1995 | Wayman et al. | 355/290 |
| 5,450,182 | 9/1995 | Wayman et al. | 355/285 |
| 5,471,288 | 11/1995 | Janes et al. | 355/285 |
| 5,471,291 | 11/1995 | Janes et al. | 355/326 R |

FOREIGN PATENT DOCUMENTS

| | | |
|---|---|---|
| SHO 63-44224 | 8/1988 | Japan . |
| 5-53457 | 3/1993 | Japan . |

OTHER PUBLICATIONS

JP 08015960 A Publication—Japan–Translating Excloser.
JP 7160135 A Abstract—Japan.

*Primary Examiner*—Nestor R. Ramirez
*Attorney, Agent, or Firm*—Annette L. Bade

[57] ABSTRACT

A fixing apparatus having a fixing film for use in an electrophotographic apparatus for fusing toner images to a copy substrate, the fixing film comprising a fluorinated carbon filled fluoroelastomer, and in embodiments, the fixing film comprises an optional substrate, an optional intermediate layer provided thereon, and an outer fluorinated carbon filled fluoroelastomer layer provided on the intermediate layer.

49 Claims, 2 Drawing Sheets

FIXING APPARATUS AND FILM

CROSS REFERENCE TO RELATED APPLICATIONS

Attention is directed to the following copending applications assigned to the assignee of the present application: U.S. application Ser. No. 08/672,803 filed Jun. 28, 1996, entitled, "Bias Charging Member with Fluorinated Carbon Filled Fluoroelastomer Outer Layer;" U.S. application Ser. No. 08/635,356 filed Apr. 19, 1996, entitled, "Bias Transfer Members with Fluorinated Carbon Filled Fluoroelastomer Outer Layer;" U.S. application Ser. No. 08/808,765 filed Mar. 3, 1997, entitled "Electrically Conductive Processes;" U.S. application Ser. No. 08/808,775, filed Mar. 3, 1997, entitled "Electrically Conductive Coatings;" U.S. application Ser. No. 08/786,614 filed Jan. 21, 1997, entitled "Ohmic Contact-providing compositions; " U.S. application Ser. No. 08/786,614, filed Jan. 21, 1997, entitled "Ohmic Contact-Providing Compositions;" U.S. application Ser. No. 08/779,287 filed Jan. 21, 1997, entitled "Intermediate Transfer Members;" and U.S. application Ser. No. 08/706,387 filed Aug. 30, 1996 entitled, "Instant On Fuser System Members." The disclosures of each of these applications are hereby incorporated by reference in their entirety.

BACKGROUND OF THE INVENTION

The present invention relates to fusing systems, and more specifically, to fixing apparatii comprising fixing films useful for fusing a latent image in an electrostatographic, especially xerographic, machine. In embodiments of the present invention, there are selected fixing films comprising an outer layer comprising a polymer, preferably a fluoropolymer, and particularly preferred a fluorinated carbon filled fluoroelastomer. In embodiments, the present invention allows for the preparation and manufacture of fixing films with excellent and, in embodiments, superior electrical and mechanical properties, including controlled conductivity in a desired resistivity range, and increased mechanical strength.

Also, in embodiments, the films are able to operate at a high operating temperature and have high heat and electrical insulation. The films also decrease the occurrence of hot offset, improve image quality and permit a decrease in contamination of other xerographic components such as photoconductors by biasing the surface of the fuser member, thereby neutralizing toner charges. Further, in embodiments, the films also exhibit excellent properties such as statistical insensitivity of conductivity to increases in temperature and to environmental changes. In addition, in embodiments, the films have a low surface energy and the conformity of the film is not adversely affected.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member is itself or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, the thermoplastic resin particles are fused to the substrate by heating to a temperature of between about 90° C. to about 200° C. or higher depending upon the softening range of the particular resin used in the toner. It is undesirable, however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combination of heat, pressure and contact time are provided. The balancing of these parameters to enable the fusing of the toner particles is well known in the art, and can be adjusted to suit particular machines or process conditions.

With the fixing apparatus using a thin film in pressure contact with a heater, the electric power consumption is small, and the warming-up period is significantly reduced or eliminated.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser, and accordingly it is desired to provide a fusing surface which has a low surface energy to provide the necessary release. To ensure and maintain good release properties of the fuser, it has become customary to apply release agents to the fuser roll during the fusing operation. Typically, these materials are applied as thin films of, for example, silicone oils to prevent toner offset.

Another important method for reducing hot offset, is to impart antistatic and/or field assisted toner transfer properties to the fuser. However, in order to control the electrical conductivity of the release layer, the conformability and low surface energy properties of the release layer are often affected.

Attempts at controlling the conductivity of the outer layer of fuser members, particularly fuser belts or films, have been accomplished by, for example, adding conductive fillers such as ionic additives to the surface layer of the fuser member.

U.S. Pat. No. 5,182,606, the entire disclosure of which is hereby incorporated by reference in its entirety, discloses an image fusing apparatus including a heater and a film movable with a recording material, the recording material having a toner image thereon which is heated through the film by heat from the heater. The film has a heat resistive layer containing inorganic electrically insulative filler materials, and a parting layer containing electrically conductive fillers such as carbon black.

U.S. Pat. No. 5,084,738, the entire disclosure of which is hereby incorporated by reference in its entirety, discloses an electrically conductive fusing film having a resistive heating layer, the volume resistivity of the resistive heating layer ranging from 20 to 200 ohm-cm. The resistivity of the layer is achieved by adding conductive carbon fillers in a polymer layer such as a fluorinated resin.

U.S. Pat. No. 5,157,446, the entire disclosure of which is hereby incorporated by reference in its entirety, discloses a heating apparatus including a heater and a film having a surface layer comprised of a fluorinated resin and carbon black.

U.S. Pat. No. 5,471,288, the entire disclosure of which is hereby incorporated by reference in its entirety, discloses an image heating apparatus including a heater and a movable film. In one embodiment, the film contains an outer layer of fluorinated resin and carbon black.

While addition of electrically conductive additives to polymers may partially control the resistivity of the polymers to some extent, there are problems associated with the use of these additives. In particular, undissolved particles frequently bloom or migrate to the surface of the polymer and cause an imperfection in the polymer. This leads to a nonuniform resistivity, which in turn, leads to poor antistatic properties and poor mechanical strength. The ionic additives on the surface may interfere with toner release and affect toner offset. Furthermore, bubbles appear in the conductive polymer, some of which can only be seen with the aid of a microscope, others of which are large enough to be observed with the naked eye. These bubbles provide the same kind of difficulty as the undissolved particles in the polymer namely, poor or nonuniform electrical properties and poor mechanical properties.

In addition, the ionic additives themselves are sensitive to changes in temperature, humidity, operating time and applied field. These sensitivities often limit the resistivity range. For example, the resistivity usually decreases by up to two orders of magnitude or more as the humidity increases from 20% to 80% relative humidity. This effect limits the operational or process latitude.

Moreover, ion transfer can also occur in these systems. The transfer of ions will lead to contamination problems, which in turn, can reduce the life of the machine. Ion transfer also increases the resistivity of the polymer member after repetitive use. This can limit the process and operational latitude and eventually the ion-filled polymer component will be unusable.

Carbon black particles can impart other specific adverse effects. Such carbon dispersions are difficult to prepare due to carbon gelling, and the resulting layers may deform due to gelatin formation. This can lead to an adverse change in the conformability of the fuser member, which in turn, can lead to insufficient fusing, poor release properties, hot offset, and contamination of other machine parts.

Generally, carbon additives tend to control the resistivities and provide somewhat stable resistivities upon changes in temperature, relative humidity, running time, and leaching out of contamination to photoconductors. However, the required tolerance in the filler loading to achieve the required range of resistivity has been extremely narrow. This, along with the large "batch to batch" variation, leads to the need for extremely tight resistivity control. In addition, carbon filled polymer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Therefore, there exists an overall need for a fusing apparatus which provides for good release properties and a decrease in the occurrence of hot offset. More specifically, there exists a specific need for a fusing apparatus having controlled resistivity in a desired range so as to neutralize toner charges, thereby decreasing the occurrence of hot offset, increasing image quality and preventing contamination of other xerographic members. In addition, there exists a specific need for a fuser member which has an outer surface having the qualities of a stable conductivity in the desired resistivity range and in which the conformability and low surface energy properties of the release layer are not affected.

SUMMARY OF THE INVENTION

Examples of objects of the present invention include:

It is an object of the present invention to provide fixing system members and methods thereof with many of the advantages indicated herein.

Another object of the present invention is to provide a fixing system member which maintains excellent release properties thereby decreasing the occurrence of hot offset.

Further, it is an object of the present invention to provide a fixing system member which neutralizes toner charges, thereby decreasing the occurrence of hot offset.

It is a further object of the present invention to provide a fixing system member which improves image quality.

It is still a further object of the present invention to provide a fixing system member which permits a decrease in contamination of other xerographic components such as photoreceptors.

It is another object of the present invention to provide a fixing system member which has superior electrical properties including a stable conductivity in the desired resistivity range.

It is yet another object of the present invention to provide a fixing system member having a low surface energy.

A further object of the present invention is to provide a fixing system member which has good conformability.

It is a further object of the present invention to provide a fixing system member which possesses a conductivity that is virtually insensitive to environmental changes and to increases in temperature.

A further object of the present invention is to provide a fixing system member which is low in cost.

Another object of the present invention is to provide a fixing system member which has high operating temperature.

Yet another object of the present invention is to provide a fixing system member which has high heat insulation, which in turn, improves the thermal efficiency of the fixing system.

Still yet another object of the present invention is to provide a fixing system member which has high electric insulation.

These and other objects have been met by the present invention which includes, in embodiments: a fixing apparatus, comprising: a) a heater; and b) in contact with the heater, a fixing film comprising a fluorinated carbon filled fluoroelastomer, wherein an image on a recording material is heated by heat generated from the heater through the fixing film.

These and other objects have further been met by the present invention which also includes, in embodiments: a fixing apparatus, comprising: a) a heater; and b) in contact with the heater, a fixing film comprising a substrate and having thereon an outer layer comprising a fluorinated carbon filled fluoroelastomer, wherein an image on a recording material is heated by heat generated from the heater through the outer layer of the fixing film.

In addition, these and other objects have been met by the present invention which further includes, in embodiments: a fixing apparatus, comprising: a) a heater; and b) in contact with the heater, a fixing film comprising a fluorinated carbon filled fluoroelastomer, wherein the fluorinated carbon is of the formula $CF_x$, and x represents the number of fluorine atoms and is from about 0.02 to about 1.5, and wherein an image on a recording material is heated by heat generated from the heater through the fixing film.

Further, these and other objects have been met by the present invention which further includes, in embodiments: a fixing apparatus, comprising: a) a heater; and b) in contact with the heater, a fixing film comprising a substrate and having provided thereon, an outer layer comprising a fluorinated carbon filled fluoroelastomer wherein the fluorinated carbon is of the formula $CF_x$, and x represents the number of fluorine atoms and is from about 0.02 to about 1.5, wherein an image on a recording material is heated by heat generated from the heater through the outer layer of the fixing film.

Moreover, these and other objects have been met by the present invention which also includes, in embodiments: a fixing apparatus, comprising: a) a heater; and b) in contact with the heater, a fixing film comprising a substrate and thereover an intermediate layer comprising silicone, and provided on the intermediate layer an outer layer comprising a fluorinated carbon filled fluoroelastomer, wherein the fluorinated carbon is of the formula $CF_x$, and x represents the number of fluorine atoms and is from about 0.02 to about 1.5, wherein an image on a recording material is heated by heat generated from the heater through the outer layer of the fixing film.

Embodiments of the present invention also include: an image forming apparatus for forming images on a recording medium comprising: a charge-retentive surface to receive an electrostatic latent image thereon; a development component to apply toner to the charge-retentive surface to develop the electrostatic latent image to form a developed image on the charge retentive surface; a transfer component to transfer the developed image from the charge retentive surface to a copy substrate; and a fixing component for fixing toner images to a surface of the copy substrate, wherein the fixing component comprises a heater and in contact with the heater, a fixing film comprising a fluorinated carbon filled fluoroelastomer, and wherein an image on a recording material is heated by heat generated from the heater through the fixing film.

In addition, embodiments of the present invention include: an electrophotographic process comprising: a) forming an electrostatic latent image on a charge-retentive surface; b) applying toner to the latent image to form a developed image on the charge-retentive surface; c) transferring the toner image from the charge-retentive surface to a copy substrate; d) fixing the toner image to the copy substrate by passing the copy substrate containing the toner image in between a heater and a fixing film, wherein the heater is in contact with the fixing film, the fixing film comprising a fluorinated carbon filled fluoroelastomer, and wherein an image on a recording material is heated by heat generated from the heater through the fixing film.

The fixing members provided herein, the embodiments of which are further described herein, enable control of the desired resistivities, allow for uniform electrical properties including resistivity, and neutralize toner charges, all of which contribute to good release properties, a decrease in the occurrence of hot offset, an increase in image quality, and a decrease in contamination of other xerographic components such as photoconductors. The fixing members provided herein, in embodiments, also have improved insensitivities to environmental and mechanical changes, have low surface energy, and have good conformability.

BRIEF DESCRIPTION OF THE DRAWINGS

For a better understanding of the present invention, reference may be had to the accompanying figures.

DETAILED DESCRIPTION OF THE PRESENT INVENTION

The present invention relates to fixing systems comprising fixing members, and, in embodiments, a heating apparatus comprising a heater generating heat and a fixing film in contact with the heater, wherein an image on a recording material is heated by heat from the heater through the film, and wherein the film comprises a layer comprising a fluorinated carbon filled fluoroelastomer.

Figure 1:
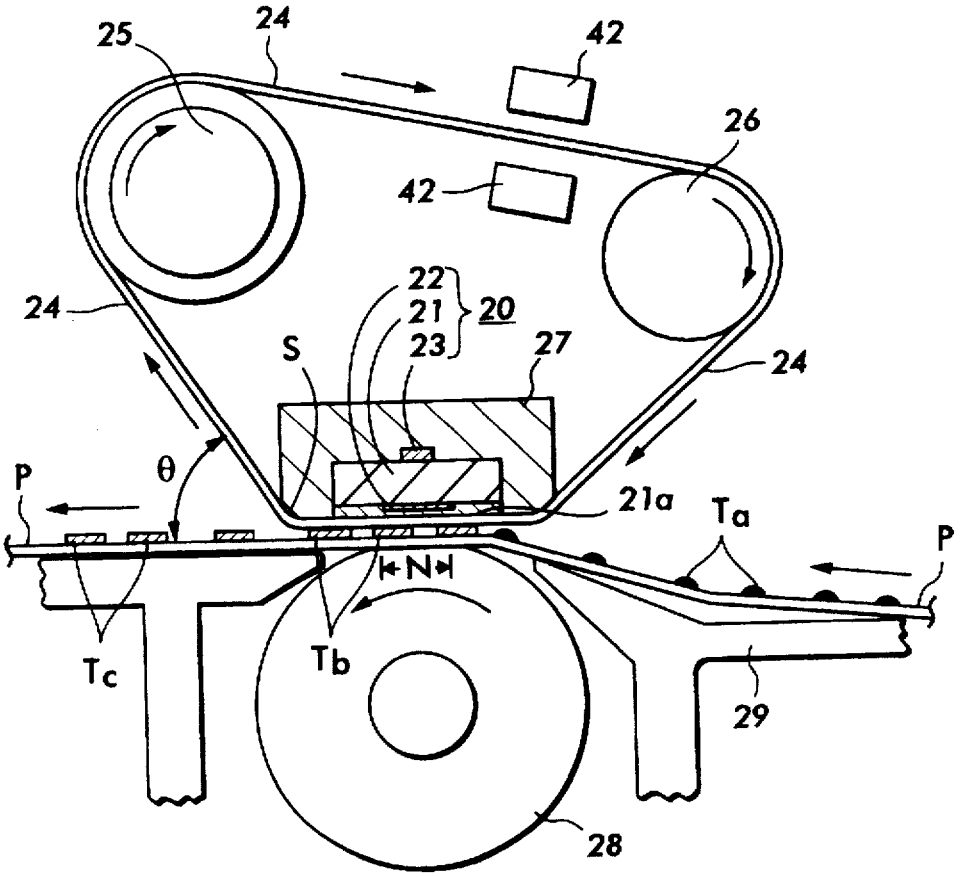
FIG. 1 is a sectional view of a fixing apparatus according to an embodiment of the invention.

FIG. 1 shows a sectional view of an example of a heating apparatus according to an embodiment of the present invention. In FIG. 1, a heat resistive film or an image fixing film 24 in the form of an endless belt is trained or contained around three parallel members, i.e., a driving roller 25, a follower roller 26 of metal and a low thermal capacity linear heater 20 disposed between the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image thereon (not shown) so that the film is not creased, skewed or delayed.

A pressing roller 28 has a rubber elastic layer with parting properties, such as silicone rubber or the like, and is press-contacted to the heater 20 with the bottom travel of the fixing film 24 therebetween. The pressing roller is pressed against the heater at the total pressure of 4–7 kg by an urging means (not shown). The pressure roller rotates co-directionally, that is, in the counterclockwise direction, with the fixing film 24.

The heater 20 is in the form of a low thermal capacity linear heater extending in a direction crossing with the film 24 surface movement direction (film width direction). It comprises a heater base 27 having a high thermal conductivity, a heat generating resistor 22 generating heat upon electric power supply thereto, and a temperature sensor 23. It is mounted on a heater support 21 having high thermal conductivity.

The heater support 21 supports the heater 20 with thermal insulation on an image fixing apparatus and is made from high heat durability resin such as PPS (polyphenylene sulfide), PAI (polyamideimide), PI (polyimide), polyaramide, polyphthalamide, polyketones, PEEK (polyether ether ketone) or liquid crystal polymer material, or a compound material of such resin material and ceramics, metal, glass or the like material.

An example of the heater base 27 is in the form of an alumina plate having a thickness of 1.0 mm, a width of 10 mm and a length of 240 mm comprised of a high conductivity ceramic material.

The heat generating resistor material 22 is applied by screen printing or the like along a longitudinal line substantially at the center, of the bottom surface of the base 27. The heat generating material 22 is, for example, Ag/Pd (silver palladium), $Ta_2N$ or another electric resistor material having a thickness of approximately 10 microns and a width of 1–3 mm. It is coated with a heat resistive glass 21*a* in the thickness of approximately 10 microns, as a surface protective layer. A temperature sensor 23 is applied by screen printing or the like substantially at a center of a top surface of the base 27 (the side opposite from the side having the heat generating material 22). The sensor is made of Pt film having low thermal capacity. Another example of the temperature sensor is a low thermal capacity thermistor contacted to the base 27.

The linear or stripe heater 22 is connected with the power source at the longitudinal opposite ends, so that the heat is generated uniformly along the heater. The power source in this example provides AC 100 V, and the phase angle of the supplied electric power is controlled by a control circuit (not shown) including triac in accordance with the temperature detected by the temperature detecting element 23.

A film position sensor 42 in the form of a photocoupler is disposed adjacent to a lateral end of the film 24. In response to the output of the sensor, the roller 26 is displaced by a driving means in the form of a solenoid (not shown), so as to maintain the film position within a predetermined lateral range.

Upon an image formation start signal, an unfixed toner image is formed on a recording material at the image forming station. The recording material sheet P having an unfixed toner image Ta thereon is guided by a guide 29 to enter between the fixing film 24 and the pressing roller 28 at the nip N (fixing nip) provided by the heater 20 and the pressing roller 28. Sheet P passes through the nip between the heater 20 and the pressing roller 28 together with the fixing film 24 without surface deviation, crease or lateral shifting while the toner image carrying surface is in contact with the bottom surface with the fixing film 24 moving at the same speed as sheet P. The heater 20 is supplied with electric power at a predetermined timing after generation of the image formation start signal so that the toner image is heated at the nip so as to be softened and fused into a softened or fused image Tb.

Fixing film 24 is sharply bent at an angle theta of, for example, about 45 degrees at an edge S (the radius of curvature is approximately 2 mm), that is, the edge having a large curvature in the heater support 21. Therefore, the sheet advanced together with the film 24 in the nip is separated by the curvature from the fixing film 24 at edge S. Sheet P is then discharged to the sheet discharging tray. By the time Sheet P is discharged, the toner has sufficiently cooled and solidified and therefore is completely fixed (toner image Tc).

The toner of resin and pigment used in this embodiment has a sufficiently high viscosity when it is heated and fused. Therefore, even if the toner temperature when it is separated from the fixing film is higher than the toner fusing point, the bonding strength among toner particles is very large when compared to the strength between the toner and the fixing films. Therefore, practically no toner offset is produced and carried over onto fixing film 24 when fixing film 24 and sheet P is separated.

In this embodiment, heat generating element 22 and base 27 of heater 20 have low thermal capacity. In addition, heater element 22 is supported on support 21 through thermal insulation. The surface temperature of heater 20 in the nip quickly reaches a sufficiently high temperature which is necessary in order to fuser the toner. Also, a stand-by temperature control is used to increase the temperature of the heater 20 to a predetermined level. Therefore, power consumption can be reduced, and rise in temperature can be prevented.

The fixing film is in contact with the heater. The distance between the outer layer of the fixing film and the heater is preferably not less than 2.5 mm, and preferably not less than 5 mm. Similarly, the distance between the fixing film and the grounded rollers 25 and 26 is not less than 5 mm. These distances prevent leakage of the charge applied to the transfer material P by an image (not shown) forming station from leaking to the ground through the transfer material P. Therefore, possible deterioration of image quality due to improper image transfer can be avoided.

In another embodiment of the invention, not shown in the figures, the fixing film may be in the form of a sheet. For example, a non-endless film may be rolled on a supply shaft and taken out to be wrapped on a take-up shaft through the nip between the heater and the pressing roller. Thus, the film may be fed from the supply shaft to the take-up shaft at the speed which is equal to the speed of the transfer material. This embodiment is described and shown in U.S. Pat. No. 5,157,446, the disclosure of which is hereby incorporated by reference in its entirety.

Figure 2:
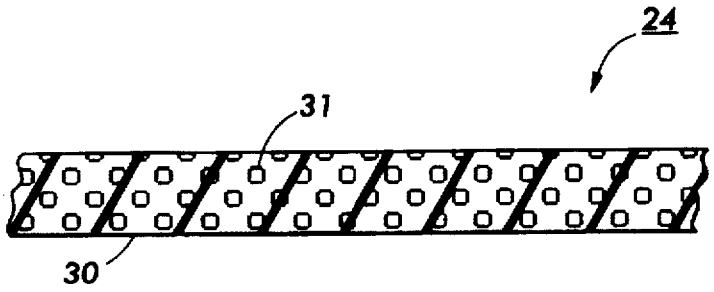
FIG. 2 is an illustration of an embodiment of the invention, wherein a one layer fixing film described herein is shown.

The fixing film of the present invention can be of at least three different configurations. In one embodiment of the invention, the fixing film 24 is of a single layer configuration as shown in FIG. 2. Preferably, the single layer 30 is comprised of a fluoropolymer, preferably a fluoroelastomer, and particularly preferred, a fluorinated carbon filled fluoroelastomer. The fluorinated carbon 31 is evenly dispersed in the fluoroelastomer. It is believed that the fluorinated carbon crosslinks with the fluoroelastomer. It is preferred that the volume resistivity of the single fluoropolymer layer is from about $10^3$ to about $10^{10}$ ohms-cm, preferably from about $10^4$ to about $10^9$ ohms-cm, and particularly preferred from about $10^5$ to about $10^8$ ohms-cm. The thickness of the single layer fixing film is from about 1 to about 20 mil, and preferably from about 2 to about 10 mil. The hardness of the single layer fixing film is less than about 85 Shore A, and preferably from about 50 to about 65 Shore A.

Figure 3:
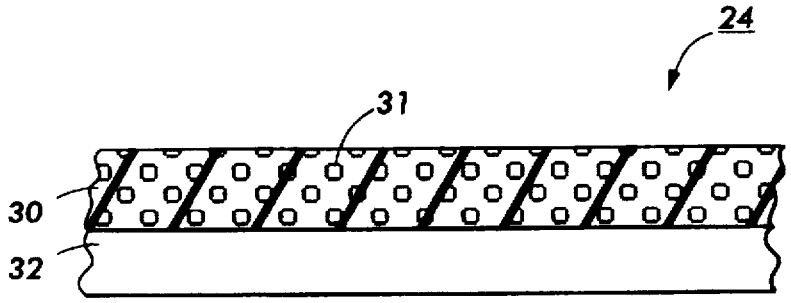
FIG. 3 is an illustration of an embodiment of the invention, wherein a two layer fixing film described herein is shown.

In another embodiment of the invention, the fixing film 24 is of a two layer configuration as shown in FIG. 3. As shown in FIG. 3, the fixing film comprises a substrate 32, and having thereon a fluorinated carbon filled fluoroelastomer outer layer 30. The fluorinated carbon filled fluoroelastomer is as described above in the description of the embodiment shown in FIG. 2. In this two layer configuration shown in FIG. 3, the substrate can be a rigid roll of from about 1 to about 5 inches in diameter made of, for example, aluminum, copper, steel, or the like. The length of the roll is from about 9 to about 15 inches.

Alternatively, the substrate can be a flexible belt made of plastic having a high operating temperature. The plastic must be suitable for allowing a high operating temperature (i.e., greater than about 180°, preferably greater than 200° C.), capable of exhibiting high mechanical strength, providing heat insulating properties (this, in turn, improves the thermal efficiency of the proposed fusing system), and possessing electrical insulating properties. In addition, it is preferred that the plastic have a flexural strength of from about 2,000,000 to about 3,000,000 psi, and a flexural modulus of from about 25,000 to about 55,000 psi. The film is from about 3 to about 36 inches, preferably from about 4 to about 20 inches in circumference. The width of the film is from about 8 to about 18 inches. It is preferably that the substrate be an endless, seamed flexible belt and seamed flexible belts, which may or may not include puzzle cut seams. Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

Figure 4:
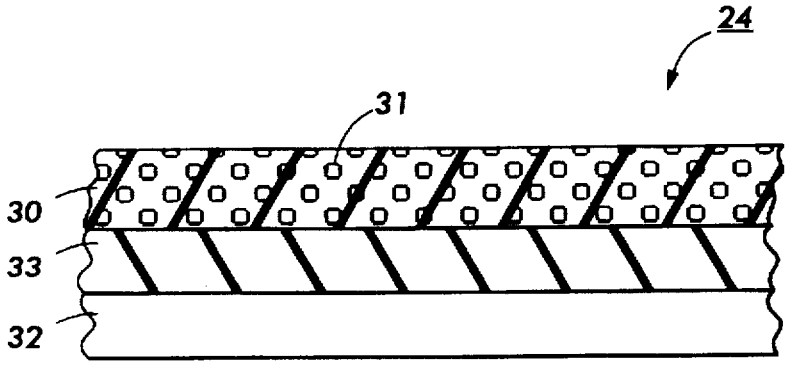
FIG. 4 is an illustration of an embodiment of the invention, wherein a three layer fixing film described herein is shown.

In another preferred embodiment of the invention, the fixing film 24 is of a three layer configuration as shown in FIG. 4. This three layer configuration provides superior conformability and is suitable for use in color xerographic machines. In this three layer configuration, the fixing film comprises a substrate 32 as defined above, and having thereon an intermediate layer 33 comprised of a conformable material such as, for example, silicone rubber, and an outer fluorinated carbon filled fluoroelastomer layer 30 positioned on the intermediate layer. The fluorinated carbon filled fluoroelastomer and the substrate are as described above. The intermediate layer has a thickness of from about 1 to about 3 mils.

The particular resistivity of the outer fluoropolymer layer can be chosen and controlled depending, for example, on the amount of fluorinated carbon, the kind of curative, the amount of curative, the amount of fluorine in the fluorinated carbon, and the curing procedures including the specific curing agent, curing time and curing temperature. The resistivity can be generated not only by selecting the appropriate curing agents, curing time and curing temperature as set forth above, but also by selecting a specific polymer and filler, such as a specific fluorinated carbon, or mixtures of various types of fluorinated carbon. The percentage of fluorine in the fluorinated carbon will also affect the resistivity of the fluoroelastomer when mixed therewith. The fluorinated carbon crosslinked with an elastomer provides unexpectedly superior results by providing a fixing film having a stable resistivity within the desired range which is virtually unaffected by numerous environmental and mechanical changes, and provides sufficient antistatic properties.

Fluorinated carbon, sometimes referred to as graphite fluoride or carbon fluoride is a solid material resulting from the fluorination of carbon with elemental fluorine. The number of fluorine atoms per carbon atom may vary depending on the fluorination conditions. The variable fluorine atom to carbon atom stoichiometry of fluorinated carbon permits systemic, uniform variation of its electrical resistivity properties. Controlled and specific resistivity is a highly desired feature for an outer surface of a fuser system member.

Fluorinated carbon, as used herein, is a specific class of compositions which is prepared by the chemical addition of fluorine to one or more of the many forms of solid carbon. In addition, the amount of fluorine can be varied in order to produce a specific, desired resistivity. Fluorocarbons are either aliphatic or aromatic organic compounds wherein one or more fluorine atoms have been attached to one or more carbon atoms to form well defined compounds with a single sharp melting point or boiling point. Fluoropolymers are linked-up single identical molecules which comprise long chains bound together by covalent bonds. Moreover, fluoroelastomers are a specific type of fluoropolymer. Thus, despite some apparent confusion in the art, it is apparent that fluorinated carbon is neither a fluorocarbon nor a fluoropolymer and the term is used in this context herein.

The fluorinated carbon material may include the fluorinated carbon materials as described herein. The methods for preparation of fluorinated carbon are well known and documented in the literature, such as in the following U.S. Pat. Nos. 2,786,874; 3,925,492; 3,925,263; 3,872,032 and 4,247,608, the disclosures each of which are totally incorporated by reference herein. Essentially, fluorinated carbon is produced by heating a carbon source such as amorphous carbon, coke, charcoal, carbon black or graphite with elemental fluorine at elevated temperatures, such as 150°–600° C. A diluent such as nitrogen is preferably admixed with the fluorine. The nature and properties of the fluorinated carbon vary with the particular carbon source, the conditions of reaction and with the degree of fluorination obtained in the final product. The degree of fluorination in the final product may be varied by changing the process reaction conditions, principally temperature and time. Generally, the higher the temperature and the longer the time, the higher the fluorine content.

Fluorinated carbon of varying carbon sources and varying fluorine contents is commercially available from several sources. Preferred carbon sources are carbon black, crystalline graphite and petroleum coke. One form of fluorinated carbon which is suitable for use in accordance with the invention is polycarbon monofluoride which is usually written in the shorthand manner $CF_x$ with x representing the number of fluorine atoms and generally being up to about 1.5, preferably from about 0.01 to about 1.5, and particularly preferred from about 0.04 to about 1.4. The formula $CF_x$ has a lamellar structure composed of layers of fused six carbon rings with fluorine atoms attached to the carbons and lying above and below the plane of the carbon atoms. Preparation of $CF_x$ type fluorinated carbon is described, for example, in above-mentioned U.S. Pat. Nos. 2,786,874 and 3,925,492, the disclosures of which are incorporated by reference herein in their entirety. Generally, formation of this type of fluorinated carbon involves reacting elemental carbon with $F_2$ catalytically. This type of fluorinated carbon can be obtained commercially from many vendors, including Allied Signal, Morristown, N.J.; Central Glass International, Inc., White Plains, N.Y.; Diakin Industries, Inc., New York, N.Y.; and Advance Research Chemicals, Inc., Catoosa, Okla.

Another form of fluorinated carbon which is suitable for use in accordance with the invention is that which has been postulated by Nobuatsu Watanabe as poly(dicarbon monofluoride) which is usually written in the shorthand manner $(C_2F)_n$. The preparation of $(C_2F)_n$ type fluorinated carbon is described, for example, in above-mentioned U.S. Pat. No. 4,247,608, the disclosure of which is herein incorporated by reference in its entirety, and also in Watanabe et al., "Preparation of Poly(dicarbon monofluoride) from Petroleum Coke", Bull. Chem. Soc. Japan, 55, 3197–3199 (1982), the disclosure of which is also incorporated herein by reference in its entirety.

In addition, preferred fluorinated carbons selected include those described in U.S. Pat. No. 4,524,119 to Luly et al., the subject matter of which is hereby incorporated by reference in its entirety, and those having the tradename Accufluor®, (Accufluor® is a registered trademark of Allied Signal, Morristown, N.J.) for example, Accufluor® 2028, Accufluor® 2065, Accufluor® 1000, and Accufluor® 2010. Accufluor® 2028 and Accufluor® 2010 have 28 and 11 percent fluorine content, respectively. Accufluor® 1000 and Accufluor® 2065 have 62 and 65 percent fluorine content respectively. Also, Accufluor® 1000 comprises carbon coke, whereas Accufluor® 2065, 2028 and 2010 all comprise conductive carbon black. These fluorinated carbons are of the formula $CF_x$ and are formed by the reaction of $C+F_2=CF_x$.

The following chart demonstrates some properties of four preferred fluorinated carbons useful in the present invention.

| PROPERTIES | ACCUFLUOR | | | | UNITS |
|---|---|---|---|---|---|
| GRADE | 1000 | 2065 | 2028 | 2010 | N/A |
| Feedstock | Coke | Conductive Carbon Black | | | N/A |
| Fluorine Content | 62 | 65 | 28 | 11 | % |
| True Density | 2.7 | 2.5 | 2.1 | 1.9 | g/cc |
| Bulk Density | 0.6 | 0.1 | 0.1 | 0.09 | g/cc |
| Decomposition Temperature | 630 | 500 | 450 | 380 | °C. |
| Median Particle Size | 8 | <1 | <1 | <1 | micrometers |
| Surface Area | 130 | 340 | 130 | 170 | $m^2/g$ |
| Thermal Conductivity | $10^{-3}$ | $10^{-3}$ | $10^{-3}$ | N.A. | cal/cm-sec-°C. |
| Electrical Resistivity | $10^{11}$ | $10^{11}$ | $10^{8}$ | <10 | ohm-cm |
| Color | Gray | White | Black | Black | N/A |

As has been described herein, it is a major advantage of the invention is the capability to be able to vary the fluorine content of the fluorinated carbon to permit systematic uniform variation of the resistivity properties of the fuser system member. The preferred fluorine content will depend on the equipment used, equipment settings, desired resistivity, and the specific fluoroelastomer chosen. The fluorine content in the fluorinated carbon is from about 1 to about 70 weight percent based on the weight of fluorinated carbon (carbon content of from about 99 to about 30 weight percent), preferably from about 5 to about 65 (carbon content of from about 95 to about 35 weight percent), and particularly preferred from about 10 to about 30 weight percent (carbon content of from about 90 to about 70 weight percent).

The median particle size of the fluorinated carbon can be less than 1 micron and up to 10 microns, is preferably less than 1 micron, and particularly preferred from about 0.5 to 0.9 micron. The surface area is preferably from about 100 to about 400 $m^2/g$, preferred of from about 110 to about 340, and particularly preferred from about 130 to about 170 $m^2/g$. The density of the fluorinated carbons is preferably from about 1.5 to about 3 g/cc, preferably from about 1.9 to about 2.7 g/cc.

The amount of fluorinated carbon in the outer layer of the fixing film is from about 1 to about 50 percent by weight of the total solids content, and preferably from about 5 to about 30 weight percent based on the weight of total solids. Total solids as used herein refers to the amount of fluoroelastomer and/or other elastomers. This amount is the amount which provides a volume resistivity of the outer layer of the fixing film of from about $10^3$ ohms-cm to about $10^{10}$ ohms-cm, preferably from about $10^4$ ohms-cm to about $10^9$ ohms-cm, and particularly preferred about $10^5$ ohms to about $10^8$ ohms.

The specific volume resistivity of outer layer of the fixing film is important in that a resistivity within a desired range such as that set forth above will significantly decrease static related adhesion of the toner to the fixing surface and provide an opportunity to drive transfer of the toner image. The result will be a decrease in hot offset and a decrease in the possibility of contamination of other electrophotographic members such as the photoreceptor. The present invention, in embodiments, provides fuser system members which possess the desired resistivity. Further, the resistivity of the present fuser member is virtually unaffected by high temperature, changes in humidity, and many other environmental changes.

It is preferable to mix different types of fluorinated carbon in order to tune the mechanical and electrical properties. For example, an amount of from about 0 to about 40 percent, and preferably from about 1 to about 35 percent by weight of Accufluor 2010 can be mixed with an amount of from about 0 to about 40 percent, preferably from about 1 to about 35 percent Accufluor 2028. Other forms of fluorinated carbon can also be mixed. Another example is an amount of from about 0 to about 40 percent Accufluor 1000 mixed with an amount of from about 0 to about 40 percent, preferably from about 1 to about 35 percent Accufluor 2065. All other combinations of mixing the different forms of Accufluor are possible.

Examples of the outer layers of the fixing film herein include polymers such as fluoropolymers. Preferred are elastomers such as fluoroelastomers. Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein these fluoroelastomers, particularly from the class of copolymers and terpolymers of vinylidenefluoride, hexafluoropropylene and tetrafluoroethylene, are known commercially under various designations as VITON A®, VITON E®, VITON E60C®, VITON E430®, VITON 910®, VITON GH® and VITON GF®. The VITON® designation is a Trademark of E. I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly (propylenetetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON GF®, available from E. I. DuPont de Nemours, Inc. The VITON GF® has 35 mole percent of vinylidenefluoride, 34 mole percent of hexafluoropropylene and 29 mole percent of tetrafluoroethylene with 2 percent cure site monomer.

Examples of fluoroelastomers suitable for use herein for the outer layer or single layer fixing film include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the fuser member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the fuser member or conductive film surface.

In embodiments, the polyorganosiloxane having functionality according to the present invention has the formula:

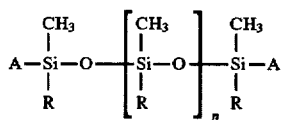

where R is an alkyl from about 1 to about 24 carbons, or an alkenyl of from about 2 to about 24 carbons, or a substituted or unsubstituted aryl of from about 4 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

In a preferred single layer embodiment of the invention, the layer is comprised of a fluorinated carbon filled fluoroelastomer, wherein the fluoroelastomer is VITON GF and the fluorinated carbon is selected from Accufluor® 1000, Accufluor® 2065, Accufluor® 2028, Accufluor® 2010, or mixtures thereof.

In the two layer configuration, the substrate herein must be suitable for allowing a high operating temperature (i.e., greater than about 180°, preferably greater than 200° C.), capable of exhibiting high mechanical strength and possessing electrical insulating properties. In addition, it is preferred that the substrate have a tensile modulus of from about 1,000,000 to about 5,000,000 psi, and a flexural strength of from about 25,000 to about 55,000 psi. Suitable materials include plastics such as, for example, Ultem® available from General Electric, Ultrapek® available from BASF, PPS (polyphenylene sulfide) sold under the tradenames Fortron® available from Hoechst Celanese, Ryton R-4® available from Phillips Petroleum, and Supec® available from General Electric; PAI (polyamide imide) sold under the tradename Torlon® 7130 available from Amoco; polyketone (PK) sold under the tradename Kadel® E1230 available from Amoco; PI (polyimide); PEEK (polyether ether ketone) sold under the tradename PEEK 450GL30 from Victrex; polyphthalamide sold under the tradename Amodel® available from Amoco; PEI (polyetherimide); PAEK (polyaryletherketone); PBA (polyparabanic acid); silicone resin; or fluorinated resin such as PTFE (polytetrafluoroethylene); polyaramide; PFA (perfluoroalkoxy); FEP (fluorinated ethylene propylene); liquid crystalline resin (Xydar®) available from Amoco, and the like, or mixtures thereof. These plastics can be filled with glass or other minerals in order to enhance their mechanical strength without changing the thermal properties. In preferred embodiments, the substrate film is comprised of a high temperature plastic with superior mechanical strength such as polyphenylene sulfide, polyamide imide, polyimide, polyketone, polyphthalamide, polyether ether ketone, polyetherimide, and polyparabanic acid.

In a preferred two layer configuration, the outer layer of the fixing film is a fluorinated carbon filled fluoroelastomer such as an Accufluor® 1000, 2065, 2028 or 2010 filled VITON GF® fluoroelastomer, and the substrate is a polyimide film in the form of either a seamed belt of an endless belt.

In a preferred three layer embodiment, the outer layer of the fixing film is a fluorinated carbon filled fluoroelastomer such as an Accufluor® 1000, 2065, 2028 or 2010 filled VITON GF® fluoroelastomer, the substrate is a polyimide film in the form of an endless belt, and the intermediate layer is a silicone layer.

The amount of fluoroelastomer used to provide the outer layer of the fixing film of the present invention is dependent on the amount necessary to form the desired thickness of the layer or layers of fixing material. Specifically, the fluoroelastomer for the outer layer is added in an amount of from about 60 to about 99 percent, preferably about 70 to about 99 percent by weight of total solids.

Any known solvent suitable for dissolving a fluoroelastomer may be used in the present invention. Examples of suitable solvents for the present invention include methyl ethyl ketone, methyl isobutyl ketone, diethyl ketone, cyclohexanone, n-butyl acetate, amyl acetate, and the like. Specifically, the solvent is added in an amount of from about 25 to about 99 percent, preferably from about 70 to about 95 percent.

The dehydrofluorinating agent which attacks the fluoroelastomer generating unsaturation is selected from basic metal oxides such as MgO, CaO, $Ca(OH)_2$ and the like, and strong nucleophilic agents such as primary, secondary and tertiary, aliphatic and aromatic amines, where the aliphatic and aromatic amines have from about 2 to about 30 carbon atoms. Also included are aliphatic and aromatic diamines and triamines having from about 2 to about 30 carbon atoms where the aromatic groups may be benzene, toluene, naphthalene, anthracene, and the like. It is generally preferred for the aromatic diamines and triamines that the aromatic group be substituted in the ortho, meta and para positions. Typical substituents include lower alkyl amino groups such as ethylamino, propylamino and butylamino, with propylamino being preferred. The particularly preferred curing agents are the nucleophilic curing agents such as VITON CURATIVE VC-50® which incorporates an accelerator (such as a quaternary phosphonium salt or salts like VC-20) and a crosslinking agent (bisphenol AF or VC-30); DIAK 1 (hexamethylenediamine carbamate) and DIAK 3 (N,N'-dicinnamylidene-1,6 hexanediamine). The dehydrofluorinating agent is added in an amount of from about 1 to about 20 weight percent, and preferably from about 2 to about 10 weight percent.

Optional intermediate adhesive layers and/or polymer layers may be applied to achieve desired properties and performance objectives of the present conductive film. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned adhesives is Dow H41.

In the two layer configuration, there may be provided an adhesive layer between the substrate and the outer conductive fluoropolymer layer. In the three layer configuration, there may also be an adhesive layer between the outer conductive fluoropolymer layer and the intermediate layer, and/or between the intermediate layer and the substrate.

In the two layer configuration, the outer fluoropolymer layer of the fixing film herein is deposited on the substrate via a well known coating processes. Known methods for forming the outer layer on the substrate film such as dipping, spraying such as by multiple spray applications of very thin films, casting, flow-coating, web-coating, roll-coating, or the like can also be used. In the three layer configuration, the intermediate layer may be deposited on the substrate in the a similar manner as the outer fluoropolymer layer is deposited on the substrate. Similarly, in the three layer configuration, the outer fluoropolymer layer may be deposited on the intermediate layer in any of the suitable manners just described. It is preferred to deposit the layers by spraying such as by multiple spray applications of very thin films, by web coating or by flow-coating.

The fixing films having an outer layer comprising a fluorinated carbon filled fluoroelastomer exhibit superior electrical and mechanical properties. The fixing films are designed so as to enable control of electrical properties including control of conductivity in the desired resistivity range, wherein the conductivity is virtually insensitive to environmental changes. Further, the fixing films have a reduced surface energy which helps to maintain excellent release properties. Moreover, the fixing films herein allow for neutralization of residual toner charge, which in turn, decreases the occurrence of hot offset, improves image quality and decreases contamination of other xerographic components. In addition, the fixing films herein have good conformability All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

A resistive layer containing 30% by weight of ACCUFLUOR® 2028 in VITON GF® was prepared in the following manner. The coating dispersion was prepared by first adding a solvent (200 g of methyl ethyl ketone), a steel shot (2,300 g) and 19.5 g of Accufluor 2028 in a small bench top attritor (model 01A). The mixture was stirred for about one minute so as to wet the fluorinated carbon. A polymer binder, Viton GF (45 g) was then added and the resulting mixture was attrited for 30 minutes. A curative package (2.25 g VC-50, 0.9 g Maglite-D and 0.2 G $CA(OH)_2$) and a stabilizing solvent (10 g methanol) were then introduced and the resulting mixture was further mixed for another 15 minutes. After filtering the steel shot through a wire screen, the dispersion was collected in a polypropylene bottle. The resulting dispersion was then coated onto Kapton substrates within 2–4 hours using a Gardner Laboratory coater. The coated layers were air-dried for approximately two hours and then step heat cured in a programmable oven. The heating sequence was as follows: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. This resulted in a Viton layer containing 30% by weight Accufluor 2028. The dry thickness of the layers was determined to be ~3 mil (~75 μm).

The surface resistivity of the cured Viton layers was measured by a Xerox Corporation in-house testing apparatus consisting of a power supply (Trek 601C Coratrol), a Keithy electrometer (model 610B) and a two point conformable guarded electrode probe (15 mm spacing between the two electrodes). The field applied for the measurement was 500 V/cm and the measured current was converted to surface resistivity based on the geometry of the probe. The surface resistivity of the layer was determined to be ~$1\times10^9$ ohm/sq.

The volume resistivity of the layer was determined by the standard AC conductivity technique. The surface of the Viton was coated directly onto a stainless steel substrate, in the absence of an intermediate layer. An evaporated aluminum thin film (300 Å) was used as the counter electrode. The volume resistivity was found to be ~$1\times10^9$ ohm-cm at an electric field of 1500 V/cm. Surprisingly, the resistivity was found to be insensitive to changes in temperature in the range of about 20° C. to about 150° C., and to changes in relative humidity in the range of about 20% to about 80%, and to the intensity of applied electric field (up to 2,000 V/cm). Furthermore, no hysteresis (memory) effect was seen after the layer was cycled to higher electric fields (>$10^4$ V/cm).

Example II

A number of resistive layers were prepared using various percentages by weight of Accufluor 2028 and Accufluor 2010 following the procedures described in Example I. These layers were found to exhibit very similar electric properties as the layers in Example 1 when measured following the same procedures. The data is summarized in Table I.

TABLE I

Resistivity Data of Fluorinated Carbon in Viton GF (field ~1500 V/cm)

| Fluorinated Carbon | Loading (% by weight) | Surface Resistivity (ohm/sq) | Volume Resistivity (ohm-cm) |
|---|---|---|---|
| Accufluor 2028 | 35 | $1.7\times10^7$ | ~$1.6\times10^8$ |
| Accufluor 2028 | 25 | $1.0\times10^{10}$ | ~$6\times10^{11}$ |
| Accufluor 2028 | 20 | $8.9\times10^{11}$ | ~$2\times10^{13}$ |
| Accufluor 2010 | 30 | $8.3\times10^4$ | |
| Accufluor 2010 | 10 | $1.9\times10^5$ | |
| Accufluor 2010 | 5 | $4.1\times10^5$ | |
| Accufluor 2010 | 3.5 | $4.5\times10^6$ | |
| Accufluor 2010 | 3 | $1.7\times10^8$ | |

Example III

A number of resistive layers were prepared using the dispersing and coating procedure as described in Example I, with the exception that a mixture of various percentages by weight of various types of Accufluors were mixed with Viton GF. The compositions of the AccufluorNiton GF layers and the surface resistivity results are summarized in Table 2.

TABLE 2

| Fillers in Viton GF (%) | Surface Resistivity (ohm/sq) |
|---|---|
| 2% Accufluor 2010<br>15% Accufluor 2028 | $4.5\times10^{11}$ |
| 2.5% Accufluor 2010<br>15% Accufluor 2028 | $1.0\times10^9$ |
| 3% Accufluor 2010<br>5% Accufluor 2028 | $5.4\times10^9$ |
| 3% Accufluor 2010<br>10% Accufluor 2028 | $6.4\times10^9$ |
| 3% Accufluor 2010<br>15% Accufluor 2028 | $1.3\times10^{10}$ |
| 3.5% Accufluor 2010<br>5% Accufluor 2028 | $2\times10^9$ |
| 3.5% Accufluor 2010<br>15% Accufluor 2010 | $7.2\times10^9$ |

Example IV

Resistive layers consisting of 25% by weight of Accufluor 2028 in Viton GF were prepared according to the procedures described in Example I. However, instead of performing a post-curing at 232° C. for 16 hours, the post-curing was performed for 9 hours, 26 hours, 50 hours, 90 hours and 150 hours, respectively. The surface resistivity results are shown in Table 3.

TABLE 3

| Post-curing Time | Surface Resistivity (ohm/sq) |
|---|---|
| 9 hours | $5.5\times10^{10}$ |
| 26 hours | $8.8\times10^9$ |
| 50 hours | $1.8\times10^9$ |
| 90 hours | $7.3\times10^7$ |
| 150 hours | $7.2\times10^6$ |

Example V

Coating dispersions containing different concentrations of Accufluor 2010 in Viton GF were prepared using the attrition procedures given in Example I. These dispersions were then air-sprayed onto Kapton substrates. The layers (~2.5 mil) were air-dried and post-cured using the procedure outlined in Example I. The surface resistivity results are summarized in Table 4 below. The percentages are by weight.

TABLE 4

| Accufluor 2010 Loading in Viton GF (%) | Surface Resistivity (ohm/sq) |
|---|---|
| 6% | $1.6\times10^{12}$ |
| 7% | $7.0\times10^8$ |
| 8% | $8.5\times10^7$ |
| 10% | $6.2\times10^6$ |
| 20% | $1.1\times10^5$ |

Example VI

A resistive layer consisting of 30% Accufluor 2028 in Viton was prepared according to the procedures described in Example I, with the exception that 4.5 g of curative VC-50 was used. The surface resistivity of the layer was measured using the techniques outlined in Example 1 and was found to be ~$5.7\times10^9$ ohm/sq.

Example VII

A coating dispersion was prepared by first adding a solvent (200 g of methyl ethyl ketone), a steel shot (2,300 g) and 2.4 g of Accufluor 2028 in a small bench top attritor (model 01A). The mixture was stirred for about one minute so as to wet the fluorinated carbon with the solvent. A polymer binder, Viton GF (45 g), was then added and the resulting mixture was attrited for 30 minutes. A curative package (0.68 g DIAK 1 and 0.2 g Maglite Y) and a stabilizing solvent (10 g methanol) were then introduced and the mixture was further mixed for about 15 minutes. After filtering the steel shot through a wire screen, the fluorinated carbonNiton GF dispersion was collected in a polypropylene bottle. The dispersion was then coated onto Kapton substrates within 2–4 hours using a Gardner laboratory coater. The coated layers were first air-dried for approximately two hours and then heat cured in a programmable oven. The heating sequence was: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. A resistive layer (~3 mil) consisting of 5% by weight Accufluor 2028 in Viton GF was formed. The surface resistivity of the layer was measured according to the procedures of Example I and was found to be ~$1\times10^8$ ohm/sq.

Example VIII

A resistive layer consisting of 5% by weight Accufluor 2028 in Viton GF was prepared according to the procedures in Example VII, with the exception that 1.36 g of DIAK 1 was used as the curative. The surface resistivity of the layer was measured at $1\times10^5$ ohm/sq.

Example IX

A coating dispersion was prepared by first adding a solvent (200 g of methyl ethyl ketone), a steel shot (2300 g) and 1.4 g of Accufluor 2028 in a small bench top attritor (model 01A). The mixture was stirred for about one minute so that the fluorinated carbon became wet. A polymer binder, Viton GF (45 g), was then added and the resulting mixture was attrited for 30 minutes. A curative package (1.36 g DIAK 3 and 0.2 g Maglite Y) and a stabilizing solvent (10 g methanol) were then introduced and the resulting mixture was further mixed for another 15 minutes. After filtering the steel shot through a wire screen, the fluorinated carbonNiton GF dispersion was collected in a polypropylene bottle. The dispersion was then coated onto Kapton substrates within 2–4 hours using a Gardner Laboratory coater. The coated layers were first air-dried for approximately 2 hours and then heat cured in a programmable oven. The heat curing sequence was: (1) 65° C. for 4 hours, (2) 93° C. for 2 hours, (3) 144° C. for 2 hours, (5) 204° C. for 2 hours and (6) 232° C. for 16 hours. A resistive layer (~3 mil) consisting of 3% Accufluor 2028 in Viton GF was formed. The surface resistivity of the layer was approximately $8\times10^6$ ohm/sq.

Example X

Resistive layers consisting of 5% Accufluor 2028 in Viton GF were prepared using the dispersion and coating procedures as outlined in Example VII, with the exception that the curing times and the curing temperatures were changed. The surface resistivities of these layers are summarized in Table 5.

TABLE 5

| Curing Temperature (°C.) | Curing time (hours) | Surface Resistivity (ohm/sq) |
|---|---|---|
| 232 | 2 | $3.6\times10^8$ |
| 232 | 4.5 | $1.2\times10^8$ |
| 232 | 8 | $1.0\times10^8$ |
| 195 | 2 | $1.9\times10^{10}$ |
| 195 | 4.5 | $6.0\times10^9$ |
| 195 | 8 | $7.7\times10^9$ |
| 195 | 23 | $3.4\times10^9$ |
| 175 | 4.5 | $5.2\times10^{10}$ |
| 175 | 23 | $2.0\times10^{10}$ |
| 149 | 8 | $5.2\times10^{11}$ |
| 149 | 23 | $2.3\times10^{11}$ |

Example XI

Resistive layers consisting of 3% by weight Accufluor 2028 in Viton GF were prepared using the dispersion and coating procedures as described in Example IX, with the exception that the curing times and the curing temperatures were changed. The surface resistivities of these layers are summarized in Table 6.

TABLE 6

| Curing Temperature (°C.) | Curing Time (hours) | Surface Resistivity (ohm/sq) |
|---|---|---|
| 235 | 2.5 | $8.1\times10^6$ |
| 235 | 6 | $8.0\times10^6$ |
| 235 | 8 | $8.0\times10^6$ |
| 175 | 2.5 | $6.6\times10^8$ |
| 175 | 6 | $4\times10^8$ |
| 175 | 24 | $8.8\times10^7$ |
| 149 | 2.5 | $1.2\times10^{10}$ |
| 149 | 6 | $7.5\times10^9$ |
| 149 | 8.5 | $6.1\times10^9$ |
| 149 | 24 | $2.5\times10^9$ |

Example XII

A fuser belt consisting of the AccufluorNiton resistive layer can be fabricated in the following manner. A 3 mil thick resistive layer, consisting of 10% Accufluor® 2010 in Viton GF®, can be sprayed onto a seamless polyimide belt (3 mi, 4" in diameter) according to the dispersion and fabrication procedures described in Example V. The surface resistivity of the Accufluor/Viton layer is believed to be approximately $6\times10^6$ ohm/sq; the hardness is estimated to be approximately 72 Shore A. The volume resistivity is believed to be about $10^6$ ohm-cm.

Example XIII

A fuser belt consisting of an AccufluorNiton resistive layer can be fabricated by web coating an AccufluorNiton dispersion onto a polyaramide (Nomex from Dupont) substrate, about 3 mil thick and 36 inches wide. An example would be to use the dispersion in Example IX, and web coat a Viton layer (approximately 4 mil thick) consisting of 3% Accufluor. After solvent drying and curing, the coated belt can be cut 20 inches long and seamed. The surface resistivity of the Viton layer is estimated to be approximately $8\times10^6$ ohm/sq and the hardness is believed to be approximately 60 Shore A. The volume resistivity is believed to be about $10^6$ ohm-cm.

Example XIV

An approximately 10 mil thick AccufluorNiton seamless belt can be fabricated by spray-coating the dispersion in Example V onto a 3 inch diameter stainless steel roll substrate. After drying and curing, the Viton layer can be removed from the substrate, resulting in a Viton belt that is believed to have a surface resistivity of approximately $6\times10^6$ ohm/sq and a hardness of approximately 72 Shore A. The volume resistivity is believed to be about $10^6$ ohm-cm.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A fixing apparatus, comprising:

a) a heater; and b) in contact with said heater, a fixing film comprising a fluorinated carbon filled fluoroelastomer, wherein the fluorinated carbon has a fluorine content of from about 5 to about 65 weight percent based on the weight of fluorinated carbon, and a carbon content of from about 95 to about 35 weight percent based on the weight of fluorinated carbon, and further wherein an image on a recording material is heated by heat generated from said heater through said fixing film.

2. A fixing apparatus in accordance with claim 1, wherein said fluorinated carbon is present in an amount of from about 1 to about 50 percent by weight based on the weight of total solids.

3. A fixing apparatus in accordance with claim 2, wherein the fluorinated carbon is present in an amount of from about 5 to about 30 percent by weight based on the weight of total solids.

4. A fixing apparatus in accordance with claim 1, wherein the fluorinated carbon has a fluorine content of from about 10 to about 30 weight percent based on the weight fluorinated carbon, and a carbon content of from about 90 to about 70 weight percent.

5. A fixing apparatus in accordance with claim 1, wherein the fluorinated carbon is of the formula $CF_x$, wherein x represents the number of fluorine atoms.

6. A fixing apparatus in accordance with claim 5, wherein the fluorinated carbon is of the formula $CF_x$, wherein x represents the number of fluorine atoms and is a number of from about 0.02 to about 1.5.

7. A fixing apparatus in accordance with claim 6, wherein the fluorinated carbon is of the formula $CF_x$, wherein x is a number of from about 0.04 to about 1.4.

8. A fixing apparatus in accordance with claim 1, wherein said fluorinated carbon is selected from the group consisting of Accufluor® 1000 having a fluorine content of 62 weight percent, Accufluor® 2010 having a fluorine content of 11 weight percent, Accufluor® 2028 having a fluorine content of 28 weight percent, and Accufluor® 2065 having a fluorine content of 65 weight percent based on the weight of fluorinated carbon.

9. A fixing apparatus in accordance with claim 1, wherein the fluoroelastomer is selected from the group consisting of a) copolymers of vinylidenefluoride, hexafluoropropylene and tetrafluoroethylene, and b) terpolymers of vinylidenefluoride, hexafluoropropylene and tetrafluoroethylene.

10. A fixing apparatus in accordance with claim 1, wherein the fluoroelastomer comprises 35 mole percent of vinylidenefluoride, 34 mole percent of hexafluoropropylene and 29 mole percent of tetrafluoroethylene.

11. A fixing apparatus in accordance with claim 1, wherein the fluoroelastomer is a volume grafted fluoroelastomer.

12. A fixing apparatus in accordance with claim 1, wherein the fluoroelastomer is present in an amount of from about 70 to about 99 percent by weight based on the weight of total solids.

13. A fixing apparatus in accordance with claim 1, wherein the film has a volume resistivity of from about $10^3$ to about $10^{10}$ ohms-cm.

14. A fixing apparatus in accordance with claim 13, wherein said film has a volume resistivity of from about $10^5$ to about $10^8$ ohms-cm.

15. A fixing apparatus in accordance with claim 1, wherein said film has a thickness of from about 1 to about 20 mil.

16. A fixing apparatus in accordance with claim 15, wherein said film has a thickness of from about 2 to about 10 mil.

17. A fixing apparatus in accordance with claim 1, wherein said film has a hardness of less than about 85 Shore A.

18. A fixing apparatus in accordance with claim 17, wherein said film has a hardness of from about 50 to about 65 Shore A.

19. A fixing apparatus, comprising:

a) a heater; and b) in contact with said heater, a fixing film comprising a substrata and having thereon an outer layer comprising a fluorinated carbon filled fluoroelastomer, wherein the fluorinated carbon has a fluorine content of from about 5 to about 65 weight percent based on the weight of fluorinated carbon and a carbon content of from about 95 to about 35 weight percent, and wherein an image on a recording material is heated by heat generated from said heater through said outer layer of said fixing film.

20. A fixing apparatus in accordance with claim 19, wherein said fluorinated carbon is present in an amount of from about 1 to about 50 percent by weight based on the weight of total solids.

21. A fixing apparatus in accordance with claim 20, wherein the fluorinated carbon is present in an amount of from about 5 to about 30 percent by weight based on the weight of total solids.

22. A fixing apparatus in accordance with claim 19, wherein the fluorinated carbon has a fluorine content of from about 10 to about 30 weight percent based on the weight of fluorinated carbon, and a carbon content of from about 90 to about 70 weight percent.

23. A fixing apparatus in accordance with claim 19, wherein the fluorinated carbon is of the formula $CF_x$, wherein x represents the number of fluorine atoms.

24. A fixing apparatus in accordance with claim 23, wherein the fluorinated carbon is of the formula $CF_x$, wherein x is from about 0.02 to about 1.5.

25. A fixing apparatus in accordance with claim 24, wherein the fluorinated carbon is of the formula $CF_x$, wherein x is from about 0.04 to about 1.4.

26. A fixing apparatus in accordance with claim 19, wherein said fluorinated carbon is selected from the group consisting of Accufluor® 1000 having a fluorine content of 62 weight percent, Accufluor® 2010 having a fluorine content of 11 weight percent, Accufluor® 2028 having a fluorine content of 28 weight percent, and Accufluor® 2065 having a fluorine content of 65 weight percent based on the weight of fluorinated carbon.

27. A fixing apparatus in accordance with claim 19, wherein the fluoroelastomer of the outer layer is selected from the group consisting of a) copolymers of vinylidenefluoride, hexafluoropropylene and tetrafluoroethylene, and b) terpolymers of vinylidenefluoride, hexafluoropropylene and tetrafluoroethylene.

28. A fixing apparatus in accordance with claim 19, wherein the fluoroelastomer of the outer layer comprises 35 mole percent of vinylidenefluoride, 34 mole percent of hexafluoropropylene and 29 mole percent of tetrafluoroethylene.

29. A fixing apparatus in accordance with claim 19, wherein the fluoroelastomer of the outer layer is a volume grafted fluoroelastomer.

30. A fixing apparatus in accordance with claim 19, wherein the fluoroelastomer of the outer layer is present in an amount of from about 70 to about 99 percent by weight based on the weight of total solids.

31. A fixing apparatus in accordance with claim 19, wherein said outer layer has a volume resistivity of from about $10^3$ to about $10^{10}$ ohms-cm.

32. A fixing apparatus in accordance with claim 31, wherein the outer layer has a volume resistivity of from about $10^5$ to about $10^8$ ohms-cm.

33. A fixing apparatus in accordance with claim 19, wherein said outer layer has a thickness of from about 1 to about 20 mil.

34. A fixing apparatus in accordance with claim 33, wherein said outer layer has a thickness of from about 2 to about 10 mil.

35. A fixing apparatus in accordance with claim 19, wherein said outer layer has a hardness of less than about 85 Shore A.

36. A fixing apparatus in accordance with claim 35, wherein said outer layer has a hardness of from about 50 to about 65 Shore A.

37. A fixing apparatus in accordance with claim 19, wherein said substrate is a flexible belt.

38. A fixing apparatus in accordance with claim 37, wherein said flexible belt is a seamed belt.

39. A fixing apparatus in accordance with claim 37, wherein said flexible belt is an endless, seamless belt.

40. A fixing apparatus in accordance with claim 39, wherein said flexible belt comprises a polymer selected from the group consisting of polyimide, polyaramide, polyether ether ketone, polyetherimide, polyparabanic acid, polyphthalamide, polyamide-imide, polyketone, and polyphenylene sulfide.

41. A fixing apparatus in accordance with claim 40, wherein said substrate comprises a polymer selected from the group consisting of polyaramide and polyimide.

42. A fixing apparatus in accordance with claim 39, wherein said flexible belt has a circumference of from about 3 to about 36 inches.

43. A fixing apparatus in accordance with claim 19, further comprising an intermediate layer positioned between said substrate and said outer layer.

44. A fixing apparatus in accordance with claim 43, wherein said intermediate layer comprises a silicone rubber.

45. A fixing apparatus in accordance with claim 43, wherein said intermediate layer has a thickness of from about 1 to about 3 mils.

46. A fixing apparatus, comprising:

a) a heater; and b) in contact with said heater, a fixing film comprising a fluorinated carbon filled fluoroelastomer, wherein the fluorinated carbon is of the formula $CF_x$, and x represents the number of fluorine atoms and is a number of from about 0.02 to about 1.5, and wherein an image on a recording material is heated by heat generated from said heater through said fixing film.

47. A fixing apparatus, comprising:

a) a heater; and b) in contact with said heater, a fixing film comprising a substrate and thereover an intermediate layer comprising silicone, and provided on said intermediate layer an outer layer comprising a fluorinated carbon filled fluoroelastomer, wherein said fluorinated carbon is of the formula $CF_x$, and x represents the number of fluorine atoms and is from about 0.02 to about 1.5, wherein an image on a recording material is heated by heat generated from said heater through said outer layer of said fixing film.

48. An image forming apparatus for forming Images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fixing component for fusing toner images to a surface of said copy substrate, wherein said fixing component comprises a heater and in contact with said heater, a fixing film comprising a fluorinated carbon filled fluoroelastomer, wherein the fluorinated carbon has a fluorine content of from about 5 to about 65 weight percent based on the weight of fluorinated carbon, and a carbon content of from about 95 to about 35 weight percent, and wherein an image on a recording material is heated by heat generated from said heater through said fixing film.

49. An electrophotographic process comprising:

a) forming an electrostatic latent image on charge-retentive surface;

b) applying toner to said latent image to form a developed image on said charge retentive surface;

c) transferring the toner image from said charge-retentive surface to a copy substrate;

d) fixing said toner image to said copy substrate by passing said copy substrate containing said toner image in between a heater and a fixing film, wherein said heater is in contact with said fixing film, said fixing film comprising a fluorinated carbon filled fluoroelastomer, wherein the fluorinated carbon has a fluorine content of from about 5 to about 65 weight percent based on the weight of fluorinated carbon, and a carbon content of from about 95 to about 35 weight percent, and wherein an image on a recording material is heated by heat generated from said heater through said fixing film.

* * * * *